US010007218B2

(12) United States Patent
Suzuki

(10) Patent No.: US 10,007,218 B2
(45) Date of Patent: Jun. 26, 2018

(54) FIXING DEVICE CAPABLE OF RESTRAINING FRICTIONAL WEARING OF NIP MEMBER AND ROLLER

(71) Applicant: Brother Kogyo Kabushiki Kaisha, Nagoya-shi, Aichi-ken (JP)

(72) Inventor: Noboru Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/457,353

(22) Filed: Mar. 13, 2017

(65) Prior Publication Data

US 2017/0343940 A1 Nov. 30, 2017

(30) Foreign Application Priority Data

May 31, 2016 (JP) ..... 2016-108850

(51) Int. Cl.
*G03G 15/20* (2006.01)

(52) U.S. Cl.
CPC ..... *G03G 15/2085* (2013.01); *G03G 15/2053* (2013.01); *G03G 2215/2035* (2013.01)

(58) Field of Classification Search
CPC ..... G03G 15/2085
See application file for complete search history.

(56) References Cited

U.S. PATENT DOCUMENTS

| | | | | |
|---|---|---|---|---|
| 7,389,079 | B2 | 6/2008 | Narahara et al. | |
| 8,909,119 | B2 * | 12/2014 | Miyahara | G03G 15/2057 399/329 |
| 9,014,609 | B2 | 4/2015 | Suzuki et al. | |
| 9,417,576 | B2 * | 8/2016 | Minamishima | G03G 15/206 |
| 2007/0258742 | A1 | 11/2007 | Narahara et al. | |
| 2013/0171473 | A1 * | 7/2013 | Zhou | H05K 5/0243 428/687 |
| 2013/0322938 | A1 * | 12/2013 | Suzuki | G03G 15/2064 399/329 |

FOREIGN PATENT DOCUMENTS

| | | |
|---|---|---|
| JP | 2007-249186 A | 9/2007 |
| JP | 2009-042279 A | 2/2009 |
| JP | 2014-006506 A | 1/2014 |

* cited by examiner

*Primary Examiner* — G.M. Hyder
(74) *Attorney, Agent, or Firm* — Banner & Witcoff, Ltd.

(57) ABSTRACT

A fixing device has: a nip member; a tubular belt looped around the nip member and including a metal tube, the metal tube having an outer peripheral surface; and a roller having a shaft and an elastic portion covering the shaft, the roller defining an axial direction, the elastic portion and the nip member being configured to nip a predetermined portion of the tubular belt. The outer peripheral surface of the metal tube has an end region in the axial direction, and a rough region between the end regions. The rough region has a surface roughness greater than a surface roughness of the end region. And the end region and the rough region provide a boundary region, therebetween which is positioned outward of the predetermined region in the axial direction.

20 Claims, 8 Drawing Sheets

FIXING DEVICE CAPABLE OF RESTRAINING FRICTIONAL WEARING OF NIP MEMBER AND ROLLER

CROSS REFERENCE TO RELATED APPLICATION

This application claims priority from Japanese Patent Application No. 2016-108850 filed May 31, 2016. The entire content of the priority application is incorporated herein by reference.

TECHNICAL FIELD

The present disclosure relates to a fixing device including an endless belt, and to a method for producing such fixing device.

BACKGROUND

A fixing device including a belt is known in the art. Such conventional fixing device includes an endless belt, a nip member provided in an internal space of the endless belt, and a pressure roller providing a nip region in cooperation with the nip member. The endless belt includes an elementary tube made from metal, and a coating layer formed over an outer surface of the elementary tube and made from fluorine contained resin.

Japanese Patent Application Publication No. 2007-249186 discloses a fixing device having an endless belt in which an outer surface of the elementary tube is subjected to blasting in order to increase bonding strength between the elementary tube and the coating layer. Further, thus publication also discloses an endless belt in which each end region of the elementary tube in a longitudinal direction thereof is subjected to masking so that an outer peripheral region of the elementary tube including a central region and other than each end region can be subjected to blasting.

SUMMARY

The present inventor has found drawbacks in the fixing device disclosed in the JP publication. That is, non-masking region is inwardly pressed due to the blasting, so that a stepped portion is generated at a portion adjacent to a boundary between the masking region and the non-masking region. The stepped portion appearing at an inner peripheral surface of the elementary tube may cause frictional wearing in the nip member and the elementary tube due to sliding contact between the endless belt and the nip member, while the inner peripheral surface is pressed by the nip member by the pressure from the pressure roller.

It is therefore an object of the disclosure to provide a fixing device capable of restraining frictional wearing of the nip member and the elementary tube.

Another object of the disclosure is to provide a method for producing such a fixing device.

These and other objects will be attained by providing a fixing device having: a nip member; a tubular belt looped around the nip member and including a metal tube, the metal tube having an outer peripheral surface; and a roller having a shaft and an elastic portion covering the shaft, the roller defining an axial direction, the elastic portion and the nip member being configured to nip a predetermined portion of the tubular belt; the outer peripheral surface of the metal tube having an end region in the axial direction, and a rough region between the end regions, the rough region having a surface roughness greater than a surface roughness of the end region; and the end region and the rough region providing a boundary region therebetween, and the boundary region being positioned outward of the predetermined portion in the axial direction.

BRIEF DESCRIPTION OF THE DRAWINGS

The particular features and advantages of the disclosure will become apparent from the following description taken in connection with the accompanying drawings, in which:

FIG. 5(*b*) is a cross-sectional view of the endless belt;

FIG. 7(*b*) is a view illustrating a mask member used in the method according to the embodiment.

DETAILED DESCRIPTION

Figure 1:
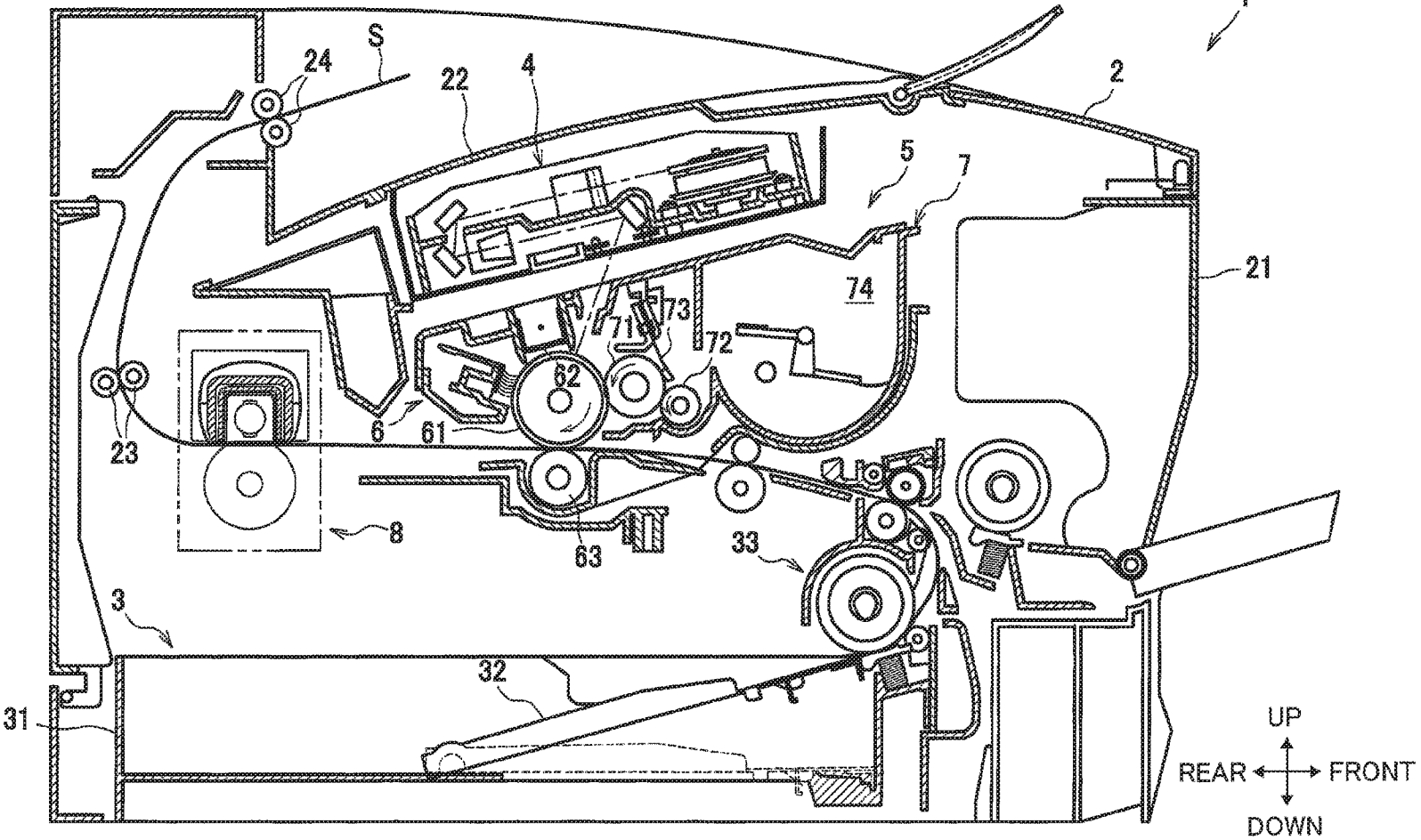
FIG. 1 is a cross-sectional view of an image forming apparatus provided with a fixing device according to one embodiment.

A fixing device according to one embodiment will be described with reference to FIGS. 1 through 7(*b*). The fixing device is provided in an image forming apparatus such as a laser printer 1 as illustrated in FIG. 1. The terms "upward", "downward", "upper", "lower", "above", "below", "beneath", "right", "left", "front", "rear" and the like will be used throughout the description assuming that the laser printer 1 is disposed in an orientation in which it is intended to be used as illustrated in FIG. 1. In FIG. 1, right side and left side are front side and rear side, respectively, a near side and far side in FIG. 1 are left side and right side, respectively, and upper side and lower side in FIG. 1 are upper side and lower side, respectively.

As illustrated in FIG. 1, the laser printer 1 includes a housing 2, a sheet supply unit 3, an exposure unit 4, a process cartridge 5, and a fixing device 8 those provided in the housing 2. The housing 2 has an opening, and a front cover 21 is provided to the housing 2. The front cover 21 is movable between an open position opening the opening, and a closed position closing the opening. The process cartridge 5 includes a photosensitive drum 61.

The sheet supply unit 3 is provided at a lower portion of the housing 2, and includes a sheet supply tray 31, a lifter plate 32, and a sheet supply mechanism 33. In the sheet supply unit 3, sheets S accommodated in the sheet supply tray 31 is urged upward by the lifter plate 32, and each one of the sheets is supplied to the process cartridge 5 by the sheet supply mechanism 33.

The exposure unit 4 is positioned at an upper portion of the housing 2, and includes a light source (not shown), a polygon mirror, a plurality of lenses, and a plurality of reflection mirrors. The exposure unit 4 is adapted to scanningly irradiate a light beam at high speed as indicated by a dotted chain line in FIG. 1 based on image data to a surface of the photosensitive drum 61 to expose the surface of the photosensitive drum 61 to light.

The process cartridge 5 is positioned below the exposure unit 4, and is attachable to and detachable from the housing 2 through the opening when the front cover 21 is open. The process cartridge 5 includes a drum unit 6, and a developing unit 7. The drum unit 6 includes the photosensitive drum 61, a charger 62, and a transfer roller 63. The developing unit 7 is attachable to and detachable from the drum unit 6, and includes a developing roller 71, a supply roller 72, a layer thickness regulation blade 73, and a toner accommodating portion 74 for accommodating toner as an example of developing agent.

In the process cartridge 5, the surface of the photosensitive drum 61 is uniformly charged by the charger 62, and then, the surface is exposed to the light beam from the exposure unit 4 to form an electrostatic latent image on the surface on a basis of image data. The toner in the toner accommodating portion 74 is supplied to the developing roller 71 through the supply roller 72. The toner is entered into a portion between the developing roller 71 and the layer thickness regulation blade 73, and is carried on the developing roller 71 as a toner layer having a uniform thickness. The toner carried on the developing roller 71 is then supplied to the electrostatic latent image to form a visible toner image on the surface of the photosensitive drum 61. Then, the sheet S supplied from the sheet supply unit 3 is conveyed to a portion between the photosensitive drum 61 and the transfer roller 63 to transfer the toner image from the surface of the photosensitive drum 61 onto the sheet S.

The fixing device 8 is positioned rearward of the process cartridge 5. Conveyer rollers 23 and discharge rollers 24 are provided at a downstream side of the fixing device 8 in a sheet conveying direction. Further, a discharge tray 22 is provided at an upper portion of the housing 2. The sheet on which the toner image has been transferred is conveyed to the fixing device 8 to thermally fix the toner image to the sheet S. The sheet S is discharged onto the discharge tray 22 through the conveyer rollers 23 and the discharge rollers 24.

Figure 2:
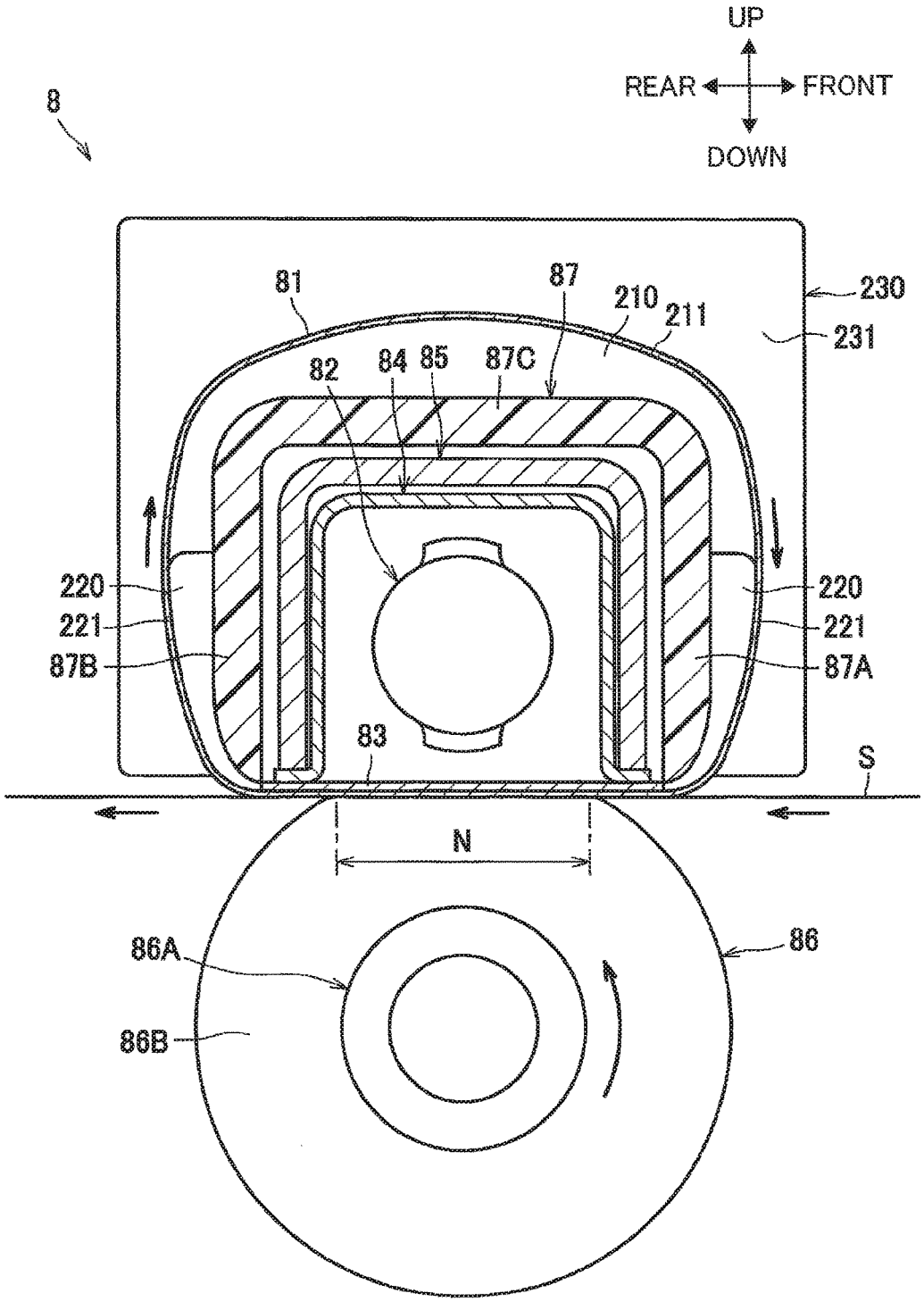
FIG. 2 is a cross-sectional view of the fixing device according to the embodiment.

As illustrated in FIG. 2, the fixing device 8 includes an endless belt 81, a halogen lamp 82, a nip member 83, a reflection member 84, a stay 85, a pressure roller 86 as an example of a roller, and a cover member 87. In the following description, an axial direction of the pressure roller 86 will be simply referred to as "axial direction", which is equivalent to a longitudinal direction of the endless belt 81. In the depicted embodiment, this direction corresponds to leftward/rightward direction.

The endless belt 81 is tubular in shape providing flexibility. The endless belt 111 has an inner peripheral surface guided by guide surfaces 211, 212 (described later) provided at the cover member 87, so that the endless belt 81 is circularly moved in clockwise direction in FIG. 2. Details of the endless belt 81 will be described later.

The halogen lamp 82 is positioned at the internal space of the endless belt 81, and is adapted to emit light upon energization for heating the nip member 83 through radiant heat.

The nip member 83 is a plate-like member for receiving radiant heat from the halogen lamp 82. The nip member 83 is positioned at the internal space of the endless belt 81, and is in contact with an inner peripheral surface of the endless belt 81. The nip member 83 is adapted to transmit the radiant heat received from the halogen lamp 82 to the endless belt 81 and to then transmit the radiant heat to the toner on the sheet S. To this effect, the nip member 83 is made from metal providing high heat conductivity, such as an aluminum plate.

The reflection plate 84 is adapted to reflect the radiant heat from the halogen lamp 82 toward the nip member 83. The reflection plate 84 is positioned at the internal space of the endless belt 81 for surrounding the halogen lamp 82. The reflection plate 84A is formed by bending a metal plate providing high reflectance of infrared ray and far infrared ray, such as an aluminium plate, into U-shape.

The stay 85 is adapted to support the nip member 83 through the reflection member 84 so as to restrain deformation of the nip member 83. The stay 85 is positioned to surround the reflection member 84, and is made from metal providing high rigidity. For example, the stay 85 is formed by bending a steel plate having relatively higher stiffness, such as a steel plate, into U-shape.

Figure 3:
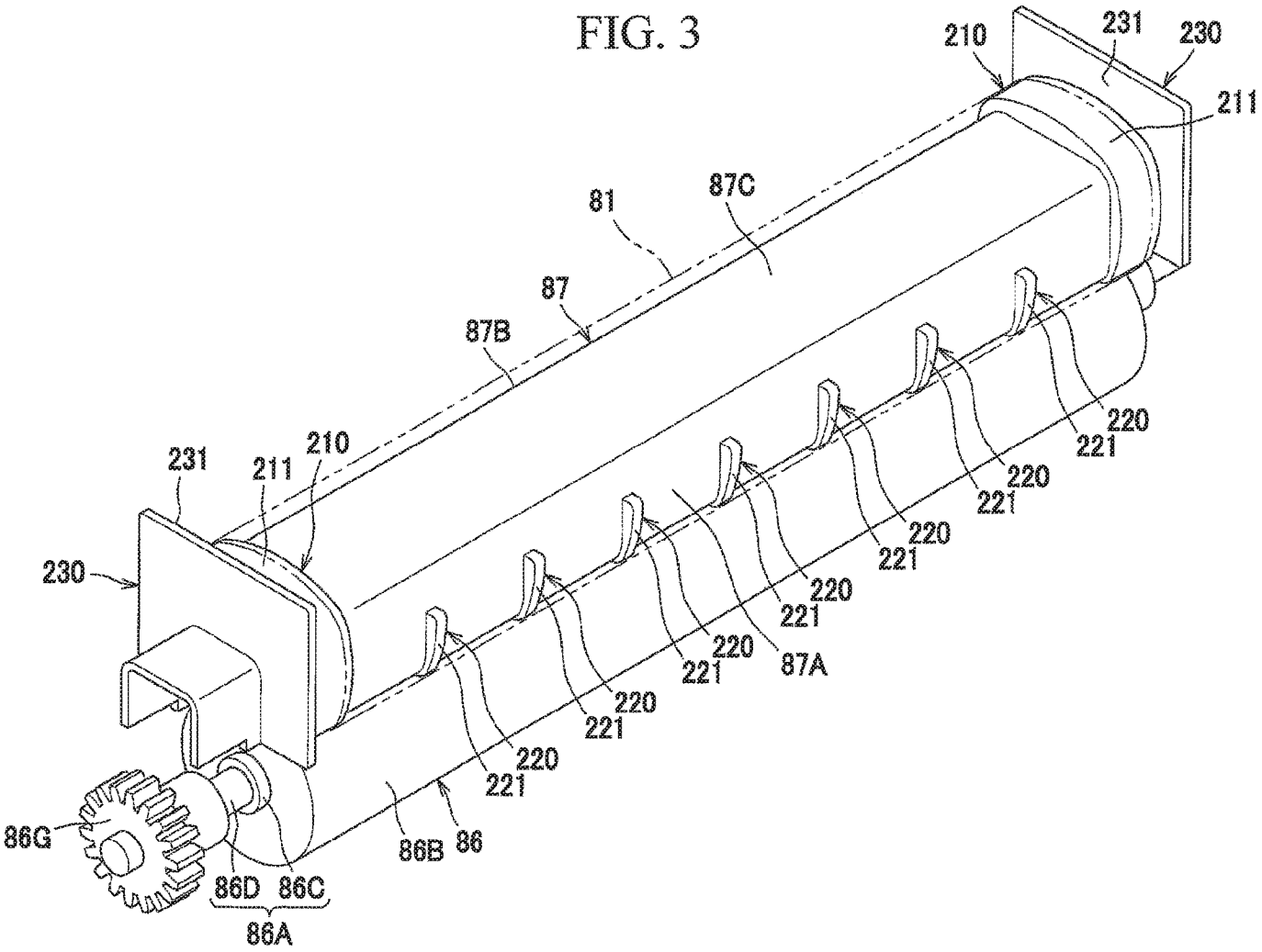
FIG. 3 is a perspective view of the fixing device according to the embodiment.

The cover member 87 is adapted to cover the stay 85 at a position opposite to the halogen lamp 82 with respect to the stay 85. The cover member 87 is elongated in the axial direction. The cover member 87 includes a first side wall 87A, a second side wall 87B, and a third side wall 87C. The first side wall 87A and the second side wall 87B are positioned at an upstream side and a downstream side of the cover member 87 in a conveying direction of the sheet S at the fixing device 8, respectively. The third side wall 87B is positioned to connect each end portion of the first and second side walls 87A, 87B together, the each end portion being opposite to each another end portion thereof, and being farther from the pressure roller 86 than each other end portion is to the pressure roller 87. As illustrated in FIG. 3, the cover member 87 is provided with end guides 210, a plurality of guide ribs 220, and end face regulation portions 230 those being examples of a guide member.

Each end guide 210 is provided at and positioned outward of each end portion of the side walls 87A, 87B, 87C in the axial direction. More specifically, the end guide 210 protrudes outward in a direction perpendicular to the axial direction. The end guide 210 has an end guide surface 211 to face the inner peripheral surface of the endless belt 81 for guiding the endless belt 81.

The end guide surface 211 is in contact with the end portion of the inner peripheral surface of the endless belt 81 in the axial direction for guiding the movement of the endless belt 81. In the depicted embodiment, each of the end guide surfaces 211 is an example of a first guide surface and a second guide surface.

The plurality of guide ribs 220 are positioned between the pair of end guides 210 and are arrayed in the axial direction. More specifically, the guide ribs 220 protrude outward from the first and second side walls 87A, 87B and extend in the moving direction of the endless belt 81. Each guide rib 210 has a rib guide surface 221 functioning as a guide surface and facing the inner peripheral surface of the endless belt 81.

The rib guide surfaces 221 are in contact with a region of the inner peripheral surface of the endless belt 81, the region being other than each end portion of the inner peripheral surface in the axial direction, particularly, the region of the endless belt 81 between the end guide surfaces 211, 211, for guiding the movement of the endless belt 81. Each rib guide surface 221 positioned at outermost end portion in the axial direction is an example of a third guide surface. A leftmost rib guide surface 221 and the left end guide surface 211 are positioned side by side, and a rightmost rib guide surface 221 and the right end guide surface 211 are positioned side by side in the axial direction.

Incidentally, lubricant such as grease is formed over the inner peripheral surface of the endless belt 81. The lubricant enhances slidability between the inner peripheral surface and the guide surfaces 211, 221 and the nip member 83 to provide desirable movement of the endless belt 81.

Each of the end surface regulation portion 230 is positioned outward of and beside each end guide 210 in the axial direction, and constitutes an end portion of the cover 87 in the axial direction. More specifically, the end surface regulation portion 230 extends outward of the side walls 87A-87C in a planar manner in the direction perpendicular to the axial direction. The peripheral portion of the end surface regulation portion 230 is positioned outward of the peripheral portion of the end guide 210. Each end surface regulation portion 230 has a regulation surface 231 facing each axial end face of the endless belt 81.

The regulation surface 231 is adapted to regulate a position of the endless belt 81 in the axial direction by abutment of the axial end face of the endless belt 81 to the regulation surface 231 when the endless belt 81 is displaced in the axial direction.

Figure 4:
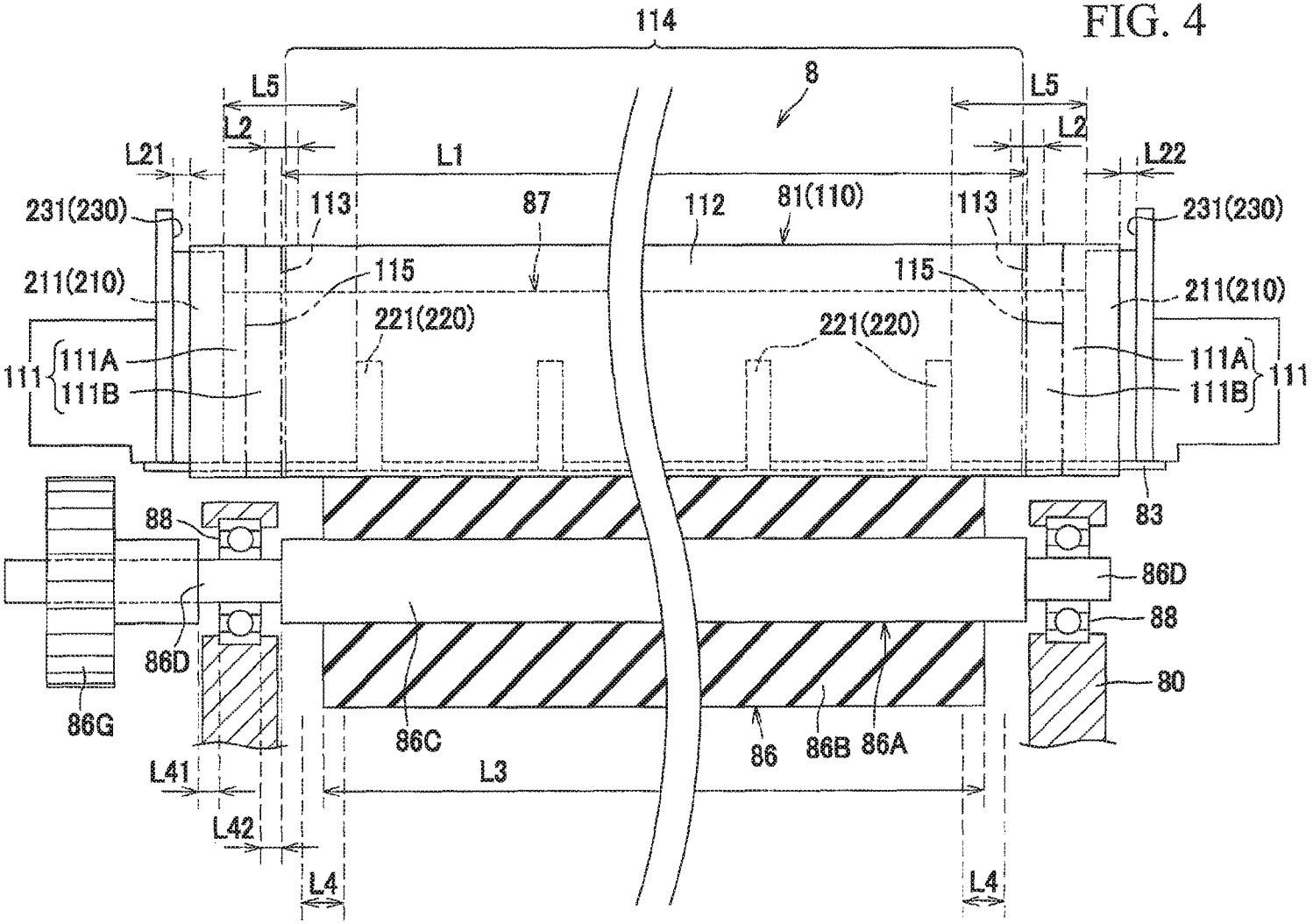
FIG. 4 is a front view of the fixing device including a partly cross-sectional view of a pressure roller.

In FIG. 4, the endless belt 81 is disposed over the cover 87 in such a manner that the belt 81 can be displaced in the axial direction relative to the regulation surfaces 231. More specifically, the endless belt 81 can be displaced leftward in the axial direction by a distance L21 between a leftmost end of the endless belt 81 and the left regulation surface 231, and can be displaced rightward in the axial direction by a distance L22 between the rightmost end of the endless belt 81 and the right regulation surface 231. Therefore, the endless belt 81 can be displaced in the axial direction by a distance L2 which is a sum of the distance L21 and the distance L22.

The pressure roller 86 includes a shaft 86A made from metal and an elastic portion 86B as an example of a backup member. The shaft 86A includes a large diameter portion 86C covered with the elastic portion 86B and small diameter portions 86D each extending outward from the large diameter portion 86C in the axial direction and having a diameter smaller than that of the large diameter portion 86C. The elastic portion 86B is made from an elastic material such as rubber, and covers the shaft 86A.

The pressure roller 86 is positioned outside of the endless belt 81 such that the elastic portion 86B and the nip member 83 nip the endless belt 81 therebetween. In the fixing device 8, one of the nip member 83 and the pressure roller 86 urges remaining one of the nip member 83 and the pressure roller 86. Thus, a nip region N (FIG. 2) is provided between the endless belt 81 and the elastic portion 86B of the pressure roller 86.

The fixing device 8 includes a frame 80. The pressure roller 86 is supported to the frame 80 such that the small diameter portion 86D of the shaft 86A is rotatably supported to the frame 80 through bearings 88. The small diameter portion 86D has an outer portion outward of the bearing 88 in the axial direction, and a gear 86G is fixed to the outer portion. In the housing 2, a motor (not shown) is provided. The pressure roller 86 is driven to be rotated in a counterclockwise direction in FIG. 2 by driving force transmitted to the gear 86G from the motor, so that the endless belt 81 is driven to be circularly moved. Accordingly, in the fixing device 8, the sheet S is conveyed between the endless belt 81 and the pressure roller 86 in the sheet conveying direction, in this embodiment, rearward.

As illustrated in FIG. 4, the pressure roller 86 is loosely supported to the bearings 88, 88 such that the pressure roller 86 is movable in the axial direction. More specifically, the pressure roller 86 is movable in the axial direction by a distance L41 which is a distance from a right end face of the gear 86G positioned in FIG. 4 to a left end face of the left bearing 88. Further, the pressure roller 86 is further movable in the axial direction by a distance L42 which is a distance from a left end face of the large diameter portion 86C positioned in FIG. 4 to a right end face of the left bearing 88. Thus, the pressure roller 86 is movable in the axial direction by a distance L4 which is a sum of the distance L41 and the distance L42.

The shaft 86A of the pressure roller 86 can be a solid shaft or a hollow shaft.

Figure 5A:
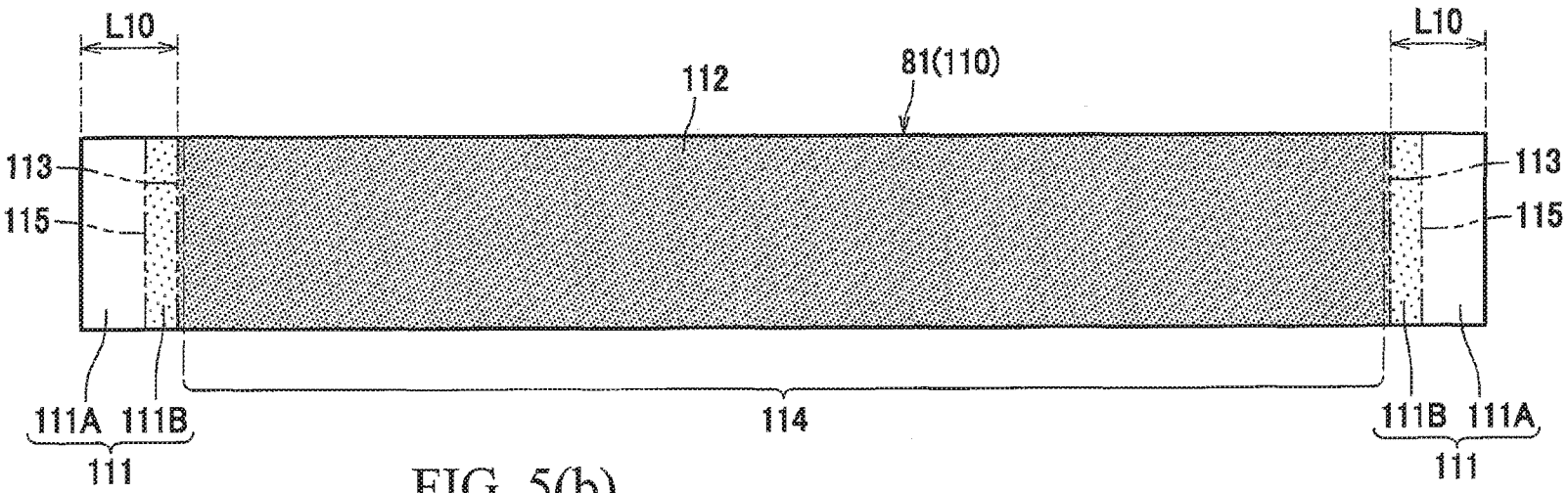
FIG. 5(*a*) is an external view of an endless belt in the fixing device according to the embodiment.
Figure 5B:
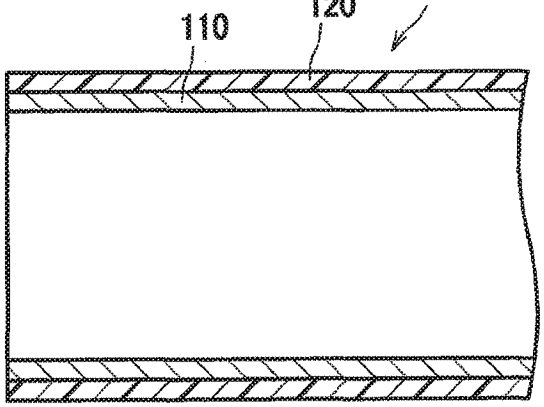

As illustrated in FIGS. 5(*a*) and 5(*b*), the endless belt 81 includes an elementary tube 110 elongated in the axial direction, and a coating layer 120 coated over an outer peripheral surface of the elementary tube 110.

The elementary tube 110 is made from metal such as stainless steel containing small amount of non-metal such as carbon. The elementary tube 110 has a thickness ranging from 30 to 50 μm. Further, the elementary tube 110 has an outer peripheral surface subjected to blasting in which blasting material is sprayed and impinged on the outer surface at high speed. The blasting material is minute bead particles made from metal, ceramic, or resin.

The outer surface of the elementary tube 110 has an end in the axial direction and includes mask regions 111 and a blasting region 112 at which blasting is performed. The outer surface also includes a boundary region 113 at a boundary between the mask region 111 and the blasting region 112. Further, the elementary tube 110 includes a nipped portion 114 nipped between the elastic portion 86B of the pressure roller 86 and the nip member 83. Strictly speaking, the nipped portion 114 is a portion that may be probably nipped between the elastic portion 86B and the nip member 83, since the endless belt 81 and the pressure roller 86 are displaceable in the axial direction.

Each mask region 111 is positioned at an end portion of the outer peripheral surface of the elementary tube 110 in the axial direction. More specifically, the each mask region 111 has a predetermined length L10 from a distal end toward another end in the axial direction. The mask region 111 includes a first mask region 111A, and a second mask region 111B. The first mask region 111A is positioned at an outermost end portion of the elementary tube 1110 in the axial direction, and the second mask region 111B is positioned between the first mask region 111A and the blast region 112. The second mask region 111B has a surface roughness greater than that of the first mask region 111A.

The blast region 112 is positioned between the mask regions 111 and 111 and has a surface roughness greater than that of the mask regions 111 because of blasting. For example, the blast region 112 has surface roughness $R_{zjis}$ ranging from 3.0 to 5.0 μm, the second mask region 111B has surface roughness $R_{zjis}$ ranging from 1.2 to 3.0 μm, and the first mask region 111A has surface roughness $R_{zjis}$ ranging from 0.5 to 1.2 μm. Here, the surface roughness $R_{zjis}$ corresponds to ten point height of irregularities (ten point average roughness) defined in Japanese Industrial Standard JIS B0601-2001. The surface roughness can be measured by roughness measuring machine such as Surfcom 130A which is a product of Tokyo Seimitsu Co., LTD.

Figure 6:
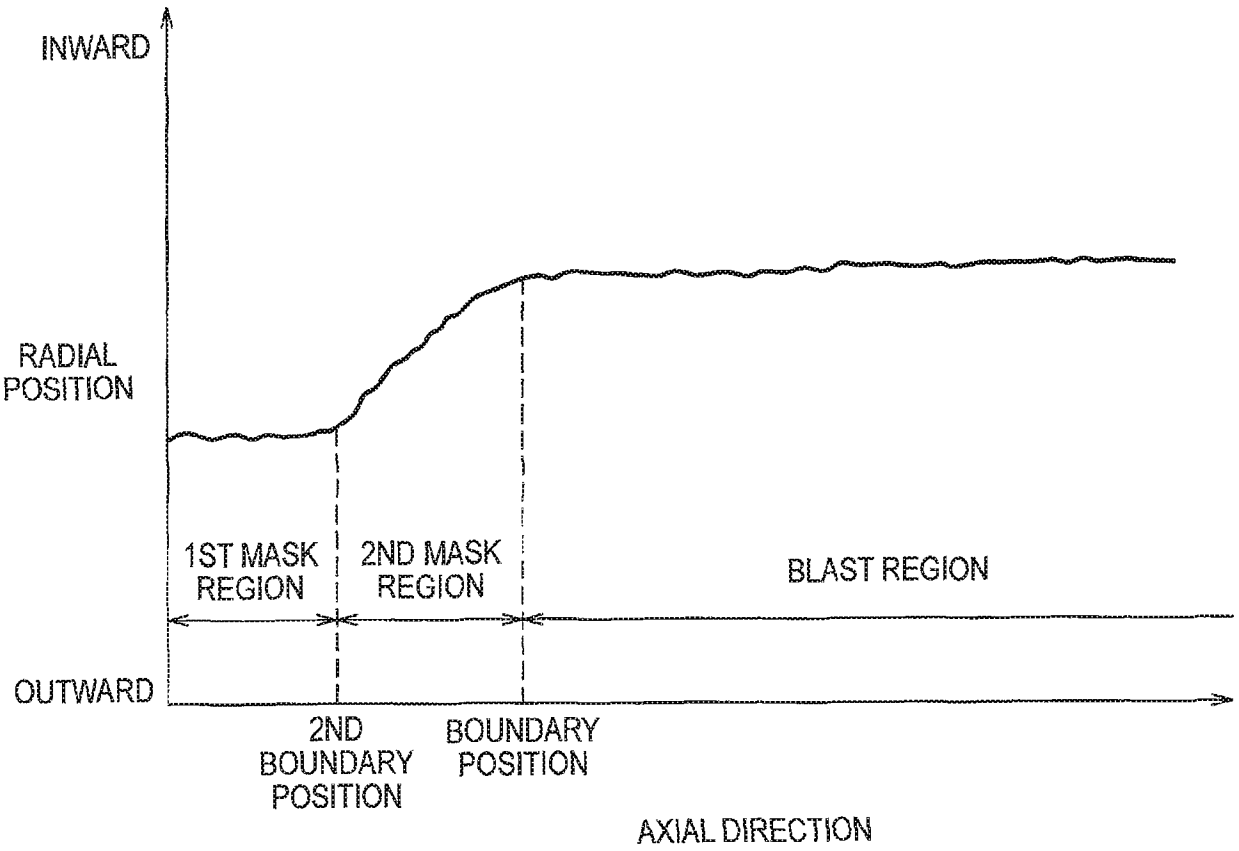
FIG. 6 is a view illustrating a shape of an inner surface of an elementary tube at its boundary portion in the endless belt.

FIG. 6 is a graphical representation illustrating a configuration of an inner surface of the boundary region 113 of the elementary tube 110. In FIG. 6, an axis of ordinate represents a radial position of the elementary tube 110, and an axis of abscissas represents an axial position thereof. In FIG. 6, high position and low position at the ordinate implies a radially inward position, and a radially outer position, respectively.

In the elementary tube 110, since the blasting material is impinged on the outer peripheral surface of the blast region 112 by way of blasting, the blast region 112 is displaced radially inward relative to the mask regions 111. Since the elementary tube 110 has a relatively small thickness, the surface uneven configuration at the outer peripheral surface is reflected into the inner peripheral surface. Therefore, the inner peripheral surface of the elementary tube 110 at its blast region 112 is displaced radially inward relative to the inner peripheral surface of the elementary tube 110 at its mask regions 111. Consequently, a stepped portion is created at the inner peripheral surface at the boundary region 113 between the inner peripheral surface at the mask region 111 and the inner peripheral surface at the blast region 112.

FIG. 5(*b*) illustrates the coating layer 120 made from fluororesin. The coating layer 120 is formed over an entire outer peripheral surface of the elementary tube 110, i.e., over the outer peripheral surfaces of the mask regions 111 and the blast region 112. In this embodiment, blast region 112 is greater than the mask regions 111. Therefore, a contacting area between the blast region 112 and the coating layer 120 can be increased, thereby increasing bonding strength therebetween. If an entire outer peripheral surface of the elementary tube 110 is coarse, irregularities at axial end portion of the elementary tube 110 may be an origin of cracking. However, according to the present embodiment, cracking at the axial end portion of the elementary tube 110 can be restrained because the mask regions 111 has a smoother surface in comparison with the blast region 112.

In the endless belt 81 as illustrated in FIG. 4, the boundary regions 113 of the elementary tube 110 are positioned axially outward of the nipped region 114. To be more specific, in the fixing device 8, the following relationship is satisfied:

$$L1>L2+L3+L4$$

where L1 is a distance between the boundary regions 113 and 113, L2 is a displaceable distance of the endless belt 81 in the axial direction, L3 is an axial length of the elastic portion 86B of the pressure roller 86, and L4 is a displaceable distance of the pressure roller 86 in the axial direction.

With the above relationship, the right boundary region 113 is positioned rightward of the right end of the elastic portion 86B, as a result of leftward movement of the endless belt 81 until the left end face of the endless belt 81 is moved from the position shown in FIG. 4 to a position in abutment with the left regulation surface 231 and as a result of rightward movement of the pressure roller 86 until the gear 86G is moved from the position shown in FIG. 4 to a position in abutment with the left bearing 88. Further, the left boundary region 113 is positioned leftward of the left end of the elastic portion 86B, as a result of rightward movement of the endless belt 81 until the right end face of the endless belt 81 is moved from the position shown in FIG. 4 to a position in abutment with the right regulation surface 231 and as a result of leftward movement of the pressure roller 86 until the large diameter portion 86C of the shaft 86A is moved from the position shown in FIG. 4 to a position in abutment with the left bearing 88.

With this structure, nipping of each boundary region 113 between the nip member 83 and the elastic portion 86B of the pressure roller 86 does not occur regardless of the axial displacement of the endless belt 81 and the pressure roller 86.

Incidentally, the right end of the elastic portion 86B becomes coincident with the right end of the nipped portion 114 in the axial direction as a result of leftward movement of the endless belt 81 until the left end of the endless belt is moved from the position shown in FIG. 4 to a position in abutment with the left regulation surface 231 and as a result of rightward movement of the pressure roller 86 until the gear 86G is moved from the position shown in FIG. 4 to a position in abutment with the left bearing 88. Further, the left end of the elastic portion 86B becomes coincident with the left end of the nipped portion 114 in the axial direction as a result of rightward movement of the endless belt 81 until the right end of the endless belt is moved from the position shown in FIG. 4 to a position in abutment with the right regulation surface 231 and as a result of leftward movement of the pressure roller 86 until the large diameter portion 86C of the shaft 86 is moved from the position shown in FIG. 4 to a position in abutment with the left bearing 88. In other words, sum of the displaceable distance L2, the length L3, and the displaceable distance L4 is equal to the length of the nipped portion 114 in the axial direction.

Further, in the endless belt 81, each boundary portion 113 of the elementary tube 110 is positioned inward of the end guide surface 211 of the end guide 210 in the axial direction. More specifically, the boundary region 113 is positioned away from the neighboring end guide surface 211 toward the other end guide surface 211. Further, each boundary region 113 is positioned between the end guide surface 211 and the rib guide surface 221 which is the outermost rib guide surface in the axial direction.

Further, in the fixing device 8, a gap distance L5 between the end guide surface 211 and the outermost rib guide surface 221 in the axial direction is greater than the displaceable distance L2 of the endless belt 81. More specifically, the left boundary region 113 is positioned rightward of the left end guide surface 211 and the right boundary region 113 is positioned rightward of the rightmost rib guide surface 221 as a result of the leftward movement of the endless belt 81 until the left end face of the endless belt 81 is moved from the position shown in FIG. 4 to a position in abutment with the left regulation surface 231. Further, the left boundary region 113 is positioned leftward of the leftmost rib guide surface 221 and the right boundary region 113 is positioned leftward of the right end guide surface 211 as a result of the rightward movement of the endless belt 81 until the right end face of the endless belt is moved from the position shown in FIG. 4 to a position in abutment with the right regulation surface 231.

The above described structure can prevent the portion of the inner peripheral surface of the elementary tube 110 (the portion being adjacent to the boundary region 113) from contacting with the end guide surface 211 and/or the rib guide surface 221.

In the endless belt 81, the first mask region 111A and the second mask region 111B define a second boundary region 115 therebetween on the elementary tube 100. The second boundary region 115 is positioned inward of the end guide surface 211 in the axial direction. More specifically, the left second boundary region 115 is positioned rightward of the left end guide surface 211 as a result of the leftward movement of the endless belt 81 until the left end face of the endless belt 81 is moved from the position shown in FIG. 4 to a position in abutment with the left regulation surface 231. Further, the right second boundary region 115 is positioned leftward of the right end guide surface 211 as a result of the rightward movement of the endless belt 81 until the right end face of the endless belt 81 is moved from the position shown in FIG. 4 to a position in abutment with the right regulation surface 231.

This structure can prevent the part of the inner peripheral surface of the elementary tube 110 (the part being adjacent to the second boundary region 115) from contacting with the end guide surface 211 regardless of the axial displacement of the endless belt 81.

Next, a method for producing the fixing device 8 will be described. First, a tubular elementary tube 110 elongated in the axial direction is formed by a conventional method using metal such as a steel stock.

Next, mask forming process is executed for forming mask regions 111 at the outer peripheral surface of the elementary tube 110. More specifically, as illustrated in FIG. 7(*a*), a mask member 300 is attached to each axial end portion of the elementary tube 110 to cover the mask region 111.

Figure 7A:
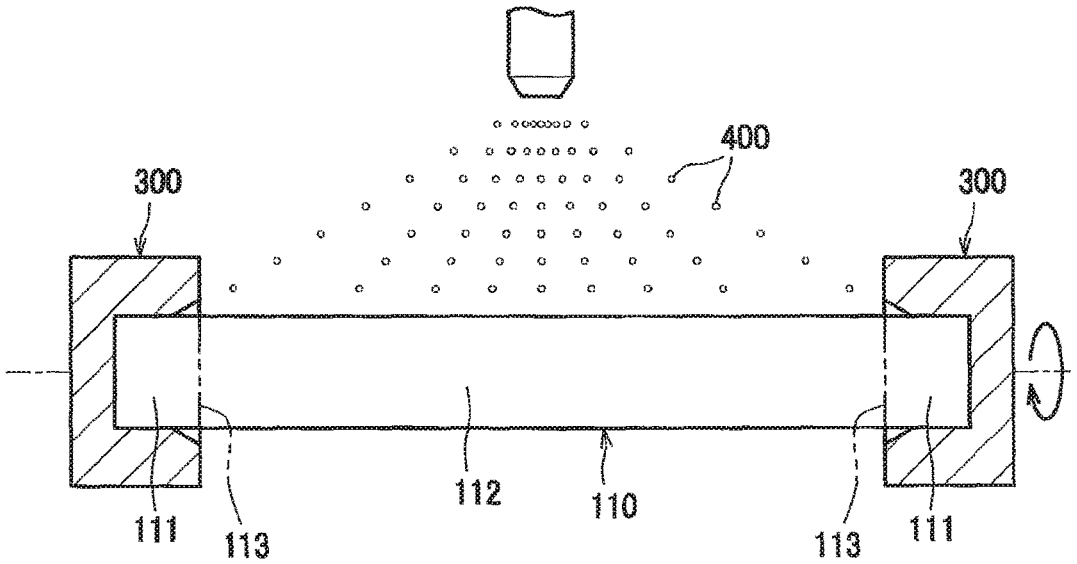
FIG. 7(*a*) is a view for description of a method for producing the fixing device according to an embodiment.
Figure 7B:
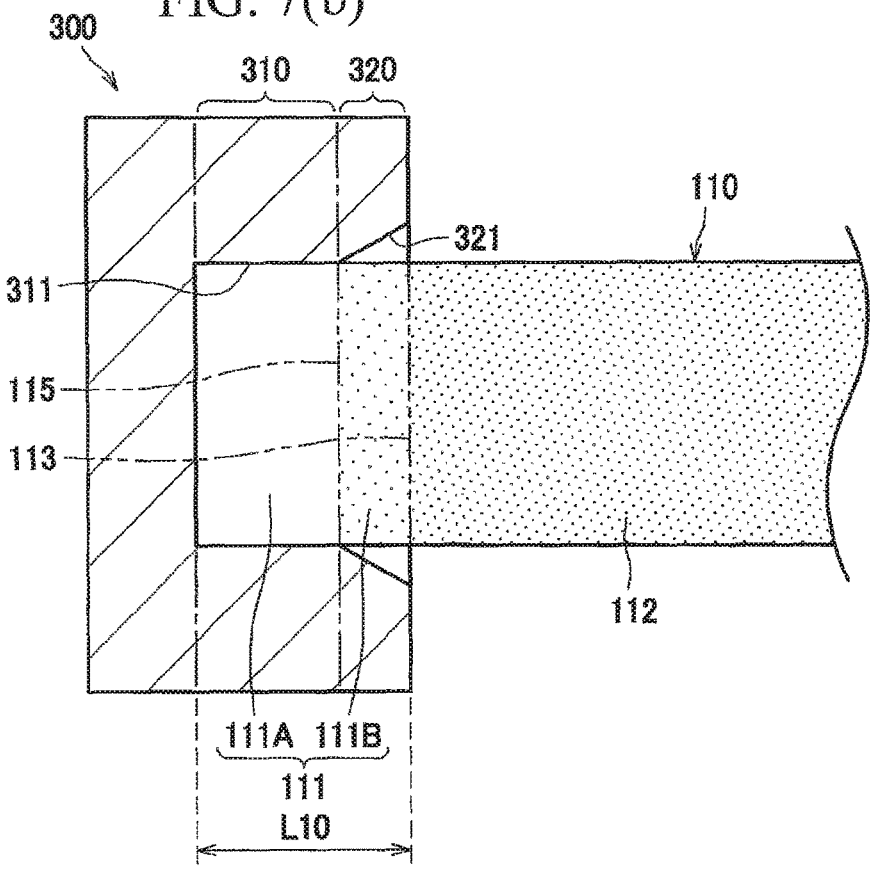

As illustrated in FIG. 7(*b*), the mask member 300 is a cup shaped member having a bottom wall and includes a first mask portion 310 masking the first mask region 111A, and a second mask portion 320 masking the second mask region 111B.

The first mask portion 310 has a first mask surface 311 in confrontation with the outer peripheral surface of the elementary tube 110, and extending in a direction generally parallel to the outer peripheral surface. No substantial gap exists between the first mask surface 311 and the mask region 111. On the other hand, the second mask portion 320 has a second mask surface 321 in confrontation with the outer peripheral surface of the elementary tube 110, and formed into frusto-conical shape in which a gap between the frusto-conical surface and the outer peripheral surface is gradually increased toward the other mask member 300. The first and second mask portions 310 and 320 provide a total axial length set to L10 in the axial direction.

After mask forming process, blasting process is executed for blasting the blasting region 112 of the elementary tube 110 while the mask regions 111 are masked by the mask members 300. In the blasting process, blasting material 400 is impinged at high speed on the blasting region 112 while the elementary tube 110 attached with the mask members 300 is rotated about its axis as illustrated in FIG. 7(*a*).

In the blasting process, a part of the blasting material is entered into the gap between the second mask surface 321 and the second mask region 111B since the second mask surface 321 has the frusto-conical shape. Accordingly, the part of the blasting material is impinged on the second mask region 111B, so that the second mask region 111B is also subjected to light blasting. As a result, the second mask region 111B provides the surface roughness greater than that of the first mask region 111A.

Since the second mask region 111B is covered with the second mask portion 320, the number of the masking material 400 impinged on the second mask region 111B is smaller than that impinged on the blasting region 112 that is not covered with the mask member 300. Accordingly, the second mask region 111B has the surface roughness smoother than that of the blasting region 112. Particularly, since the second mask surface 321 is formed such that the gap between the second mask surface 321 and the outer peripheral surface of the elementary tube 110 is gradually increased in the axially inward direction, the number of blasting material 400 impinged on the second mask region 111B is gradually decreased in the axially outward direction. As a result, surface roughness of the second mask region 111B is gradually smoother toward the first mask region 111A positioned axially outward of the second mask region 111B.

As described above, the boundary region 113 of the elementary tube 110 can be positioned at the position remote from the axial end of the elementary tube 110 by the predetermined length L10, that is, the boundary region 113 can be positioned axially outward of the nipped portion 114 as illustrated in FIG. 5(*a*), by performing blasting process while the mask members 300 are masking the axially end portions of the outer peripheral surface of the elementary tube 110 by the predetermined length of L10 from each axial end thereof. Further, the boundary region 113 can be positioned axially inward of the end guide surface 211 as illustrated in FIG. 4, and the boundary region 113 can be positioned between the end guide surface 211 and the outermost rib guide surface 221 in the axial direction.

After the blasting process, the mask members 300 are removed from the elementary tube 110, and coating layer forming process is executed for forming the coating layer 120 over the outer peripheral surface of the elementary tube 110. More specifically, in the coating layer forming process, a tubular member made from PFT (tetrafluoroethylene-perfluoro alkyl vinyl ether copolymer) is covered over the elementary tube 110. Thus, the coating layer 120 is formed over the outer peripheral surface of the elementary tube 110.

Then, components including the endless belt 81 thus formed are assembled together to thus produce the fixing device 8.

According to the above-described embodiment, nipping to the boundary region 113 by the elastic portion 86B and the nip member 83 is prevented as illustrated in FIG. 4, since the boundary region 113 is positioned axially outward of the nipped portion 114 of the elementary tube 110. Therefore, pressure contact between the nip member 83 and the stepped portion (FIG. 6) formed at the inner peripheral surface of the boundary region 113 can be restrained. As a result, frictional wearing of the nip member 83 and the elementary tube 110 can be restrained.

Further, a contact between the end guide surface 211 and the stepped portion at the inner peripheral surface of the boundary region 113 does not occur because the boundary region 113 is positioned axially inward of the end guide surface 211. Therefore, frictional wearing of the end guide 210 and the elementary tube 110 can be restrained.

Further, a contact of the end guide surface 211 or the axially outermost rib guide surface with the stepped portion at the inner peripheral surface of the boundary region 113 can be avoided, since the boundary region 113 is positioned between the end guide surface 211 and the axially outermost rib guide surface 221. Therefore, frictional wearing of the end guide 210, the guide rib 220 and the elementary tube 110 can be restrained.

Further, the surface roughness of the second mask region 111B is gradually smoother toward the first mask region 111A. Therefore, sudden change in the surface roughness between the blast region 112 and the first mask region 111A can be eliminated. Turning back to FIG. 6, inward displacement amount of the blast region 112 is large to generate a large step or level difference at the inner peripheral surface of the boundary region 113, if the surface roughness of the elementary tube 110 is suddenly changed. On the other hand, according to the present embodiment, the step or level difference can be made small at the inner peripheral surface of the boundary region 113 by gradually smoothening the surface roughness of the second mask region 111B toward the first mask region 111A. Consequently, frictional wearing of the nip member 83 and the elementary tube 110 can be restrained in spite of the contact of the stepped portion with the nip member 83.

Further, nipping to the boundary region 113 between the elastic portion 86B of the pressure roller 86 and the nip member 83 does not occur even by the displacement of the endless belt 81 and/or the pressure roller 86 in the axial direction. Therefore, pressure contact between the nip member 83 and the stepped portion formed at the inner peripheral surface of the boundary region 113 can be restrained. Consequently, frictional wearing of the nip member 83 and the elementary tube 110 can further be restrained.

Further, the contact of the stepped portion formed at the inner peripheral surface of the boundary region 113 with the end guide surface 211 and/or the rib guide surface 221 does not occur in spite of the axial displacement of the endless belt 81. Therefore, frictional wearing of the end guide 210, the guide rib 220 and the elementary tube 110 can further be restrained.

Further, the contact of the end guide surface 211 with a part of the inner peripheral surface of the elementary tube 110, the part being adjacent to the second boundary region 115, does not occur in spite of the axial displacement of the endless belt 81. Therefore, frictional wearing of the end guide 210 and the elementary tube 110 can be restrained. In addition, as illustrated in FIG. 6, at the portion adjacent to the second boundary region 115, the inner peripheral surface of the second mask region 111B is sloped radially inwardly with distance from the first mask region 111A in the axial direction. If sliding contact between the sloped surface and the end guide surface 211 occurs, the axially inward end of the end guide surface 211 and the inner surface of the mask region 111B may be frictionally worn. However, the present embodiment can avoid such frictional wearing.

Further, generation of wear debris can be restrained since frictional wearing of the nip member 83, the end guide 210, the guide rib 220, and the elementary tube 110 can be restrained. Generation of the wear debris may cause contamination of the lubricant with the wear debris, the lubricant being applied to the endless belt and the nip member. Increase in amount of the wear debris contained in the lubricant leads to increase in viscosity of the lubricant, which causes increase in moving torque of the endless belt. Accordingly slippage of the endless belt relative to the nip member may occur. Such slippage may cause sheet jamming and degradation of an output image. According to the present embodiment, slippage of the endless belt 81 can be restrained by restraining generation of the wear debris, thereby restraining sheet jamming and degradation of imaging.

Figure 8:
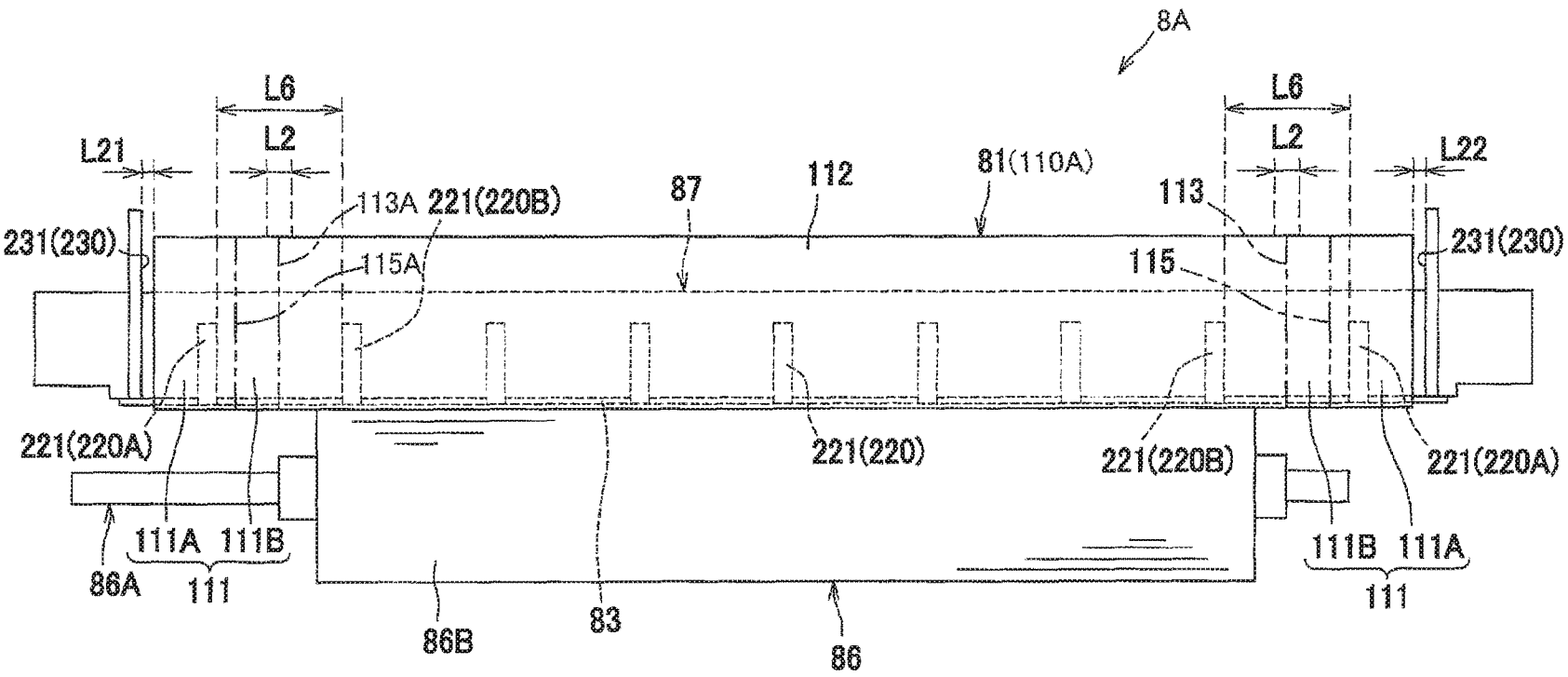
FIG. 8 is a front view of a fixing device according to a modified embodiment.

Various modifications may be conceivable. For example, in the above-described embodiment, the end guide surface 211 is exemplified as the second guide surface. However, according to a fixing device 8A illustrated in FIG. 8, the second guide surface can be a rib guide surface 221 of a first guide rib 220A which is an outermost rib in the axial direction.

Incidentally, in the fixing device 8A, a second guide rib 220B is positioned axially inward of and adjacent to the first guide rib 220A. The second guide rib 220B has a rib guide surface 221 which is an example of a third guide surface. Further, a boundary region 113A of an elementary tube 110A is positioned between the rib guide surface 221 of the first guide rib 220A and the rib guide surface 221 of the second guide rib 220B. Further, a gap distance L6 between the neighboring rib guide surfaces 221 and 221 in the axial direction is greater than the displaceable distance L2 of the endless belt 81. With this arrangement, the inner peripheral surface of the boundary region 113A and the second boundary region 115A does not contact the rib guide surface 221 of the first guide rib 220A regardless of the axial movement of the endless belt 81.

Further, in the above-described embodiment, the end guide 210 and the guide ribs 220 those being examples of guide members are integral with the cover member 87 covering the stay 85. However, the end guide 210 can be a separate component separated from the cover member 87. Further, the end face regulation portions 230 can also be a separate component separated from the cover member 87. Further, in the above-described embodiment, the plurality of guide surfaces 211, 221 are provided for guiding the movement of the endless belt 81. However, a single guide surface is available.

Further, in the above-described embodiment, the mask region 111 includes two regions having surface roughness different from each other. However, only a single mask region having uniform surface roughness over its area is available. Alternatively, the mask region can include three or more regions having surface roughness different from one another. Incidentally, a part of the mask region forming a boundary region against the blast region preferably has a surface roughness which is not largely different from the surface roughness of the blast region in order to make the stepped portion at the inner peripheral side of the boundary region as small as possible.

Further, in the above-described embodiment, the endless belt 81 has a dual layered construction including the elementary tube 110 and the coating layer 120. However, a triple layered structure in which an elastic layer such as a rubber layer is interposed between the elementary tube and the coating layer is also available. Further, a four layered construction is also available.

Further, in the above-described embodiment, the roller type elastic member such as the elastic portion 86B of the pressure roller 86 is exemplified as the backup member nipping the endless belt in cooperation with the nip member. However, a plate-like or block like elastic body is available as the backup member instead of the roller type elastic member.

Further, the monochromatic laser printer 1 provided with the fixing device according to the present invention is described. However, an image forming apparatus other than the monochromatic laser printer 1 is available such as a color printer, a copying machine, and a multi-function device those including an image reader such as a flat-bed type scanner.

While the description has been made in detail with reference to specific embodiment thereof, it would be apparent to those skilled in the art that various changes and modifications may be made therein without departing from the spirit and scope of the above described embodiment.

What is claimed is:

1. A fixing device comprising:

a nip member;

a tubular belt looped around the nip member and comprising a metal tube, the metal tube having an outer peripheral surface; and a roller comprising a shaft and an elastic portion covering the shaft, the roller defining an axial direction, the tubular belt having a nipped region encompassing every portion of the tubular belt nipped between the elastic portion and the nip member;

the outer peripheral surface of the metal tube having an end region in the axial direction, and a rough region between the end regions, the rough region having a surface roughness greater than a surface roughness of the end region; and the end region and the rough region providing a boundary region therebetween, and the boundary region being positioned outward of an entirety of the nipped region in the axial direction.

2. The fixing device according to claim 1, wherein the metal tube is made from stainless steel.

3. The fixing device according to claim 1, wherein the tubular belt further comprises a coating layer made from fluororesin, and covers at least a portion of the outer peripheral surface of the metal tube.

4. The fixing device according to claim 3, wherein the coating layer of the tube covers the end region and the rough region of the outer peripheral surface of the metal tube.

5. The fixing device according to claim 1, wherein the elastic portion of the roller is made from rubber.

6. The fixing device according to claim 1, further comprising:

a guide member having a first guide surface configured to contact an inner peripheral surface of the end region of the metal tube in the axial direction to guide the tubular belt, the boundary region of the metal tube being positioned inward of the first guide surface in the axial direction.

7. The fixing device according to claim 6, wherein the guide member further has a second guide surface positioned away from the first guide surface in the axial direction, the boundary region being positioned between the first guide surface and the second guide surface in the axial direction.

8. The fixing device according to claim 1, wherein the end region of the metal tube includes a first end region, and a second end region positioned between the first end region and the rough region, the second end region having a surface roughness greater than a surface roughness of the first end region.

9. The fixing device according to claim 1, wherein the rough region of the tube is subject to blasting, and the end region of the metal tube is masked during the blasting.

10. The fixing device according to claim 1, wherein the nip member comprises a plate-like metal member.

11. A fixing device comprising:

a nip member;

an endless belt elongated in a longitudinal direction and comprising an endless metal layer and having an outer peripheral surface, the endless metal layer being looped around the nip member; and a backup member configured to nip the endless belt in cooperation with the nip member to provide a nipped region of the endless belt, the nipped region encompassing every portion of the endless belt nipped between the backup member and the nip member, the outer peripheral surface of the metal layer having an end in the longitudinal direction, a first region including the end, and a second region positioned adjacent to the first region in the longitudinal direction and having a surface roughness greater than that of the first region, the first region and the second region providing a boundary region therebetween, and the boundary region being positioned outward of an entirety of the nipped region in the longitudinal direction, and the boundary region being not nipped between the nip member and the backup member.

12. The fixing device according to claim 11, wherein the metal layer is made from stainless steel.

13. The fixing device according to claim 11, further comprising:

a guide member having a first guide surface configured to guide an inner peripheral surface of an end portion of the endless belt in the longitudinal direction, the boundary region of the metal layer being positioned inward of the first guide surface in the longitudinal direction.

14. The fixing device according to claim 13, wherein the guide member further has a second guide surface positioned away from the first guide surface in the longitudinal direction, the boundary region being positioned between the first guide surface and the second guide surface in the longitudinal direction.

15. The fixing device according to claim 14, wherein the first region of the metal layer includes a first portion, and a second portion positioned between the first portion and the second region and having a surface roughness greater than that of the first portion.

16. The fixing device according to claim 13, wherein the first region of the metal layer includes a first portion, and a second portion positioned between the first portion and the second region and having a surface roughness greater than that of the first portion.

17. The fixing device according to claim 13, wherein the nip member comprises a plate-like metal member.

18. The fixing device according to claim 11, wherein the first region of the metal layer includes a first portion, and a second portion positioned between the first portion and the second region and having a surface roughness greater than that of the first portion.

19. The fixing device according to claim 11, wherein the nip member comprises a plate-like metal member.

20. A method for producing a fixing device including an endless belt comprising a metal tube, a nip member in contact with an inner peripheral surface of the endless belt, and a backup member configured to nip the endless belt in cooperation with the nip member, a nip region of the endless belt encompassing every portion of the endless belt nipped between the nip member and the backup member, the method comprising:

masking each of a plurality of end portions of an outer peripheral surface of the metal tube to form a mask region at each of the end portions in a longitudinal direction of the metal tube; and blasting a blast region at the outer peripheral surface of the metal tube while masking each of the end portions, the blast region being located between the mask regions, the masking and the blasting being performed such that a boundary region between each of the mask regions and the blast region is formed at a position outward of an entirety of the nip region in the longitudinal direction.

* * * * *